US005105582A

United States Patent [19]

Bell et al.

[11] Patent Number: 5,105,582

[45] Date of Patent: Apr. 21, 1992

[54] CUP CUTTER SHARPENER

[76] Inventors: Peter M. Bell, 316 Blossom Hill Rd., San Jose, Calif. 95123-2007; Thomas A. Bell, 898 N. 19th St., San Jose, Calif. 95112

[21] Appl. No.: 686,663

[22] Filed: Apr. 17, 1991

[51] Int. Cl.[5] ..... B24B 7/08; B24B 9/00

[52] U.S. Cl. ..... 51/80 R; 51/80 BS; 51/82 BS; 51/98 BS; 51/98 SP; 76/85

[58] Field of Search ..... 51/72 R, 80 R, 80 BS, 51/82 BS, 91 R, 91 BS, 92 R, 92 BS, 98 R, 98 BS, 98 HK, 98 SP, 99, 168, 285, 290, 326, 327; 76/82, 85, 115

[56] References Cited

U.S. PATENT DOCUMENTS

| | | | |
|---|---|---|---|
| 2,009,386 | 7/1935 | Clauss | 51/80 BS |
| 2,264,065 | 11/1941 | Broberg | 51/80 R |
| 2,869,288 | 1/1959 | Bretscher | 51/92 R |
| 4,612,738 | 9/1986 | Pittinger | 51/168 |
| 4,672,777 | 6/1987 | Dunkin | 76/82 |
| 4,759,153 | 7/1988 | Cohen | 76/82 |

FOREIGN PATENT DOCUMENTS

| | | | |
|---|---|---|---|
| 0349017 | 11/1985 | European Pat. Off. | 51/92 BS |

*Primary Examiner*—Bruce M. Kisliuk
*Assistant Examiner*—Bo Bounkong
*Attorney, Agent, or Firm*—Keith Kline

[57] ABSTRACT

The present invention is a golf cup cutter sharpener. The sharpener consists of one or more grinding wheels affixed in a rigid housing. The grinding wheels are cylindrical metal elements covered by a removable, and thus replaceable, abrasive surface. The wheels are belt driven, and powered by a standard electrical motor. The grinding wheels are aligned according to the geometry of the sharpener. The angle of the wheels is chosen so as to provide the proper angle of grinding to create a sharp cutting edge. If two wheels are utilized, the wheels are positioned to contact two non-adjacent scallops of the sharpener. A mandrel holds the cup cutter in place while the sharpening operation is taking place.

8 Claims, 3 Drawing Sheets

CUP CUTTER SHARPENER

FIELD OF THE INVENTION

The present invention relates to the field of golf course maintenance equipment, and more specifically is a mechanized cup cutter sharpener.

BACKGROUND OF THE INVENTION

One of the items of routine maintenance on a golf course is cutting the hole in the green. The placement is varied to alter the way the holes play, and to distribute wear evenly about the green surface.

The tool used to cut the holes in the green is called a cup cutter, or hole cutter. The cup cutter is a tool present at every golf course. The cup cutter is placed on the green at the position desired for the cup, and then is twisted into the ground. In this manner, a cylindrical element of earth is removed, and the cup is installed therein.

Clearly, the sharper the cutting edge of the cup cutter, the less work is required to place the cup. In that the cutter routinely slices through dirt, rocks, and roots, frequent sharpening is required to maintain a honed cutting edge.

Nowhere in the prior art does there exist a machine that effectively accomplishes this task. One disadvantage of the prior art devices is that they are designed to sharpen only one surface at a time. Because of the physical nature of the cup cutter, the cutting edge invariably has multiple surfaces.

Moreover, the cutting surfaces (termed "scallops") necessarily form a circle, and each individual scallop is itself arced. (See inset, FIG. 1.) Prior art sharpening devices are simply not equipped to handle the geometry of the cup cutter.

SUMMARY OF THE INVENTION

Accordingly, it is an object of the present invention to provide a device that will sharpen multiple surfaces of a cup cutter.

It is a further object of the present invention to provide a device that performs the sharpening by machine, as opposed to manually.

Another object of the present invention is to enable the construction of a machine that is relatively low cost in comparison to the sharpening time that it saves.

The present invention is a cup cutter sharpener. The sharpener consists of one or more grinding wheels affixed in a rigid housing. The grinding wheels are cylindrical elements covered by a removable, and thus replaceable, abrasive surface. The wheels are belt driven, and powered by one or more standard electrical motors.

The grinding wheels are aligned according to the geometry of the sharpener. In the typical embodiment, where two wheels are utilized to sharpen a four-scallop cutter, wheels are positioned to contact two non-adjacent scallops of the sharpener. The angle of the wheels is such that they and provide the proper angle of grinding to create an effective cutting edge.

A mandrel is affixed to the sharpener housing to facilitate holding the cup cutter in place during the sharpening operation. The mandrel has an angled offset in its lateral segment to accommodate the plunger commonly found in cup cutters.

These and other objects and advantages will become apparent to those skilled in the art in view of the description of the best presently known mode of carrying out the invention as described herein and as illustrated in the drawings.

BEST MODE OF CARRYING OUT THE INVENTION

Figure 2:
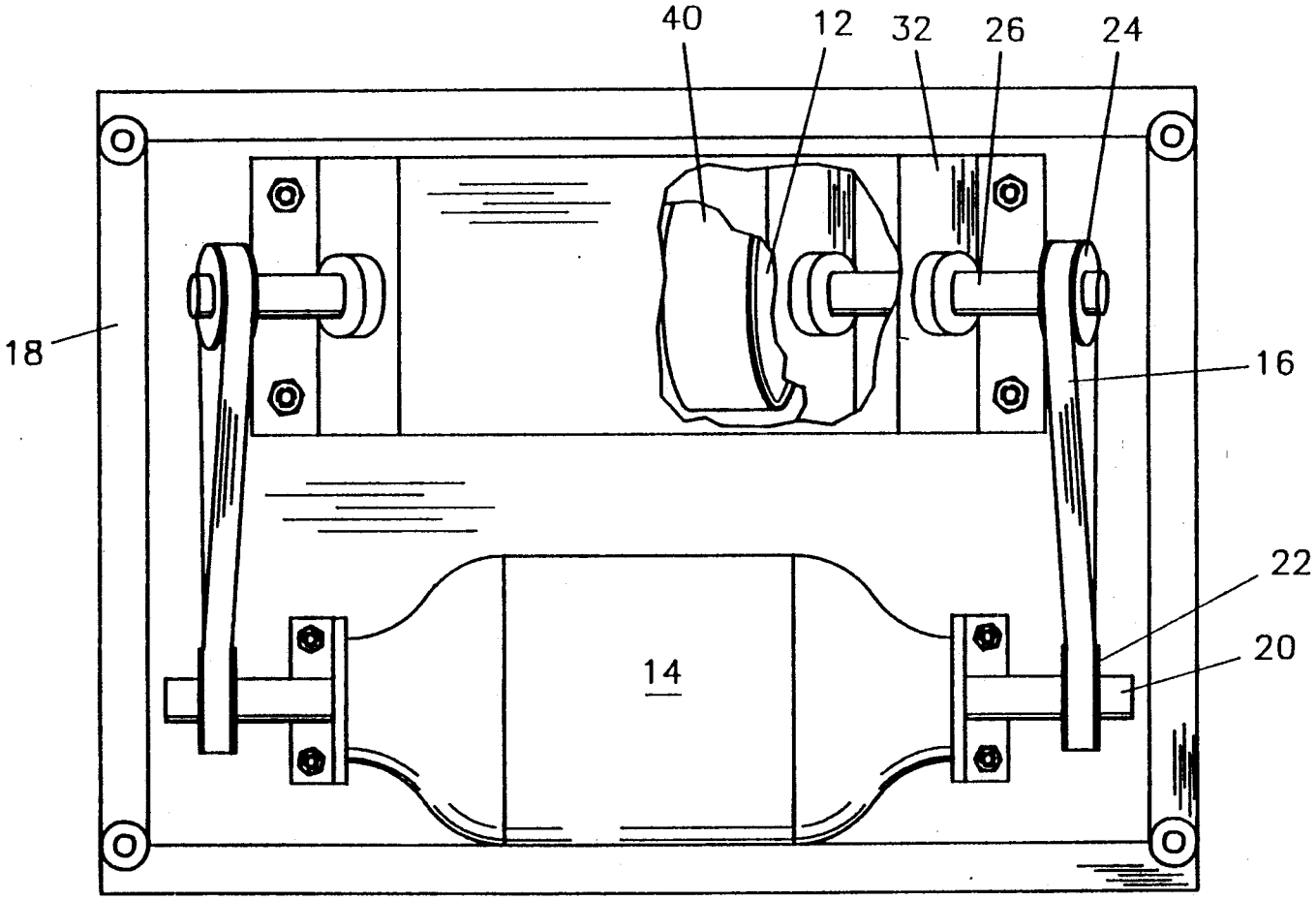
FIG. 2 is a bottom view of the cup cutter sharpener.

The present invention is a cup cutter sharpener 10. The sharpener 10 comprises one or more grinding wheels 12, an electric drive motor 14, and one or more drive belts 16 contained in a housing 18. The conformation of these components is most easily seen by referring to FIG. 2, an underside view of the sharpener 10.

Power is supplied to the sharpener 10 by the drive motor 14. In the preferred embodiment, the drive motor 14 is a "dual" model. That is, the drive shaft 20 of the motor 14 extends from both ends of the motor 14 so that two wheels 12 may be driven simultaneously. It is envisioned that an alternate embodiment may include two motors, each driving a separate grinding wheel.

In the preferred embodiment, there are two grinding wheels 12. In that the two wheels 12 are mirror images of each other, the operation of only one will be described in detail following. It is understood that the operation of the mirror image wheel is identical.

Power is supplied to the grinding wheels 12 from the motor 14 via a drive belt 16. The drive belt 16 connects a motor pulley 22 and a driving pulley 24. The driving pulley 24 is affixed to a first end of a grinding wheel axle 26.

The axle 26 passes through a first bearing 28 and a second bearing 30. At the second end of the axle 26, the grinding wheel 12 is affixed. Thus, when power is supplied to the motor 14, the drive shaft 20 rotates, which turns the belt 16, which in turn spins the axle 26 connected to the grinding wheel 12. In practice, the sharpener operates at approximately 3,000 rpm.

The grinding wheels 12 and the axles 26 are held in place by means of an angled support chassis 32. The chassis 32 is attached to the housing 18 of the sharpener 10. To provide stability when the axle 26 rotates, the chassis 32 has two points of support, the bearings 28 & 30. This allows a smooth rotation of the wheel 12 and axle 26 when the sharpener 10 is in operation.

Figure 1:
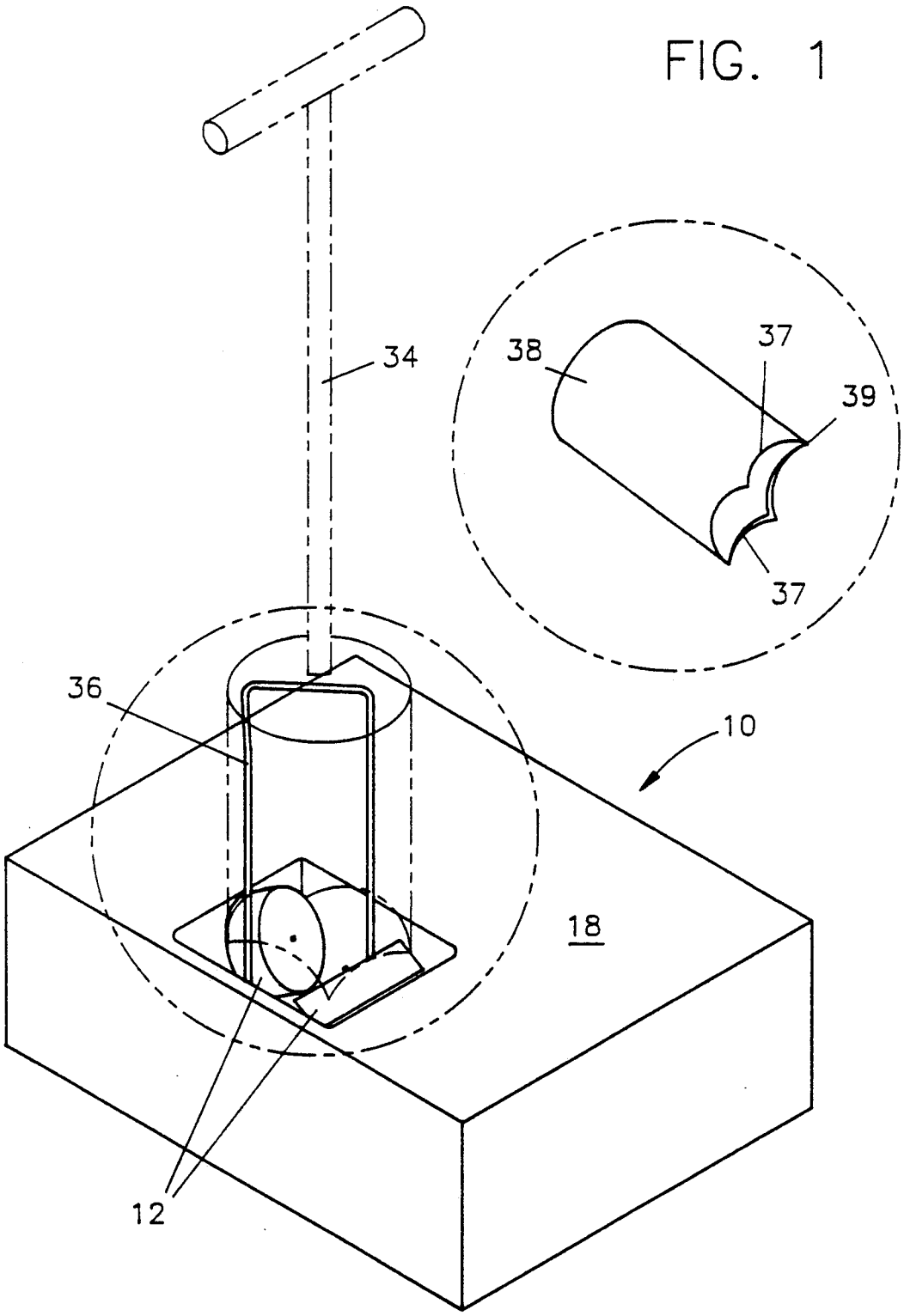
FIG. 1 is a perspective view of a cup cutter sharpener with the cup cutter (in phantom) in position to be sharpened; a cutter shell is shown in the inset.

The overall construction of the grinding wheels and their drive mechanisms is as follows: the motor drive shafts 20 extend from each end of the motor 14. Belts 16 connect the drive shafts 20 to the driving pulleys 24. The pulleys 24 are affixed to one end of the axle 26. The axles are supported by two bearings 28 & 30, which provide stability when the axle rotates. The grinding wheels 12 are affixed to the other end of the axles 26. The wheels 12 are positioned so that their grinding surface protrudes through an opening in the housing 18, and is above the plane of the housing 18. (See FIG. 1.)

Figure 3:
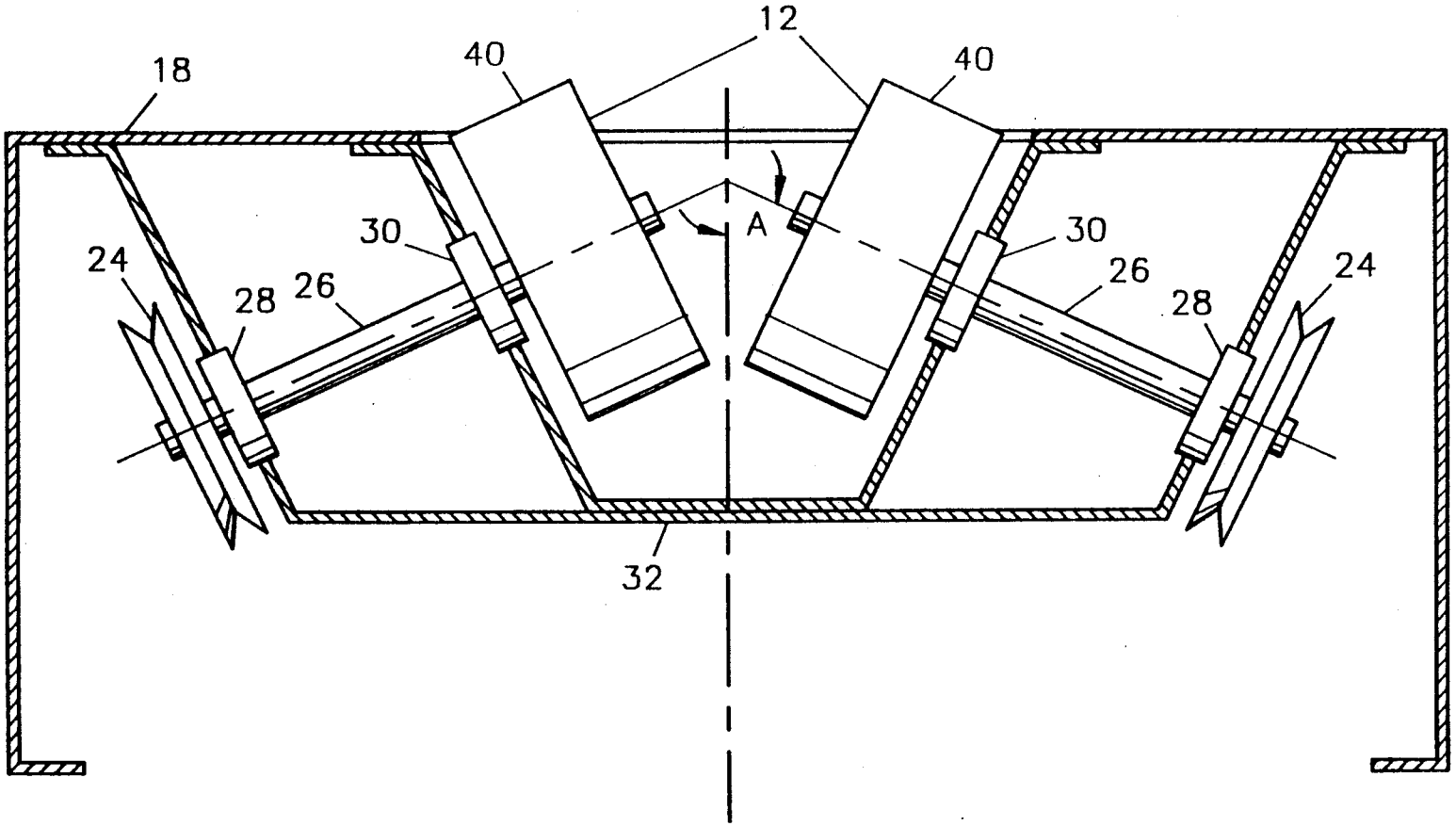
FIG. 3 is a cutaway view of the drive mechanism of the grinding wheels.

The wheels and their drive mechanisms are positioned at an angle so that non-perpendicular grinding may be accomplished. The angle between a line following the longitudinal axis of the axle 26 and a vertical line (Angle A in FIG. 3) is approximately 64°. Sharpening is accomplished by grinding a cutting surface 39 of the shell at an angle, thus forming a sharp edge. In the preferred embodiment, the angle of the cutting surface is 64°.

During the sharpening operation, a cup cutter 34 is positioned, in a vertical orientation, on the sharpener 10. This causes two non-adjacent scallops 37 of the cutting surface 39 to come into contact with the grinding wheels 12.

The cutter 34 is held in position on the sharpener 10 by a mandrel 36. The horizontal portion of the mandrel 36 has an offset to accommodate the plunger found in most cup cutters. (The plunger facilitates the ejectment of the cylinder of earth that the cutter removes when cutting a hole for the cup.)

An abrasive band 40 provides the grinding surface on the wheel 12. The band 40 is friction fit to the wheel 12. In the preferred embodiment, the wheel is made of slightly compressible rubber to facilitate the removable abrasive band. The outer surface of the band 40 is covered with abrasive material such as that found on normal grinding or sanding wheels. The abrasive material is generally bonded to a cloth backing. Plastic or cardboard may also be used as a backing material. The band 40 is easily replaceable, so that an effective grinding surface may be maintained at all times.

It has been discovered that a mandrel 36 that allows the shell 38 to "float" somewhat gives maximum performance. This is the reason that the mandrel is generally rectangular in configuration. A mandrel that conforms to the shape of the shell 38 holds it strictly in place while being sharpened. Since there is no movement of the shell at all, the abrasive band 40 wears out quickly in the one small region where the cutting surface 39 contacts the band 40.

The generally rectangular mandrel 36 of the preferred embodiment allows the shell 38 to "float", or move within a limited range, while being sharpened. This floating causes a wider portion of the abrasive band 40 to be worn by the sharpening process. The sharpener 10 is constructed so that the shell 38 contacts the band 40 at the band's midpoint when the shell 38 is placed over the mandrel 36. Torque from the wheels 12 causes the shell 38 to tend to rise off the wheels 12. Thus, the upper half of the band 40 is worn by the sharpening process. The force tending to lift the shell from the wheels is slight in that the torques of the two wheels oppose, and to a large degree cancel, each other. While there is slight movement of the shell, the cutter is not thrown from the sharpener.

In that only one half of the surface of the band 40 is worn during sharpening, it can essentially be used twice. When one half of the band 40 becomes extremely worn, the band may be reversed on the wheel 12, thus allowing the second half of the surface to be used, and extending the life of the band 40.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

We claim:

1. A device for sharpening a cup cutter, comprising:

a grinding wheel with an abrasive surface on a periphery of said wheel;

a motor to supply power to the grinding wheel;

means to transfer power from the motor to the wheel; and an enclosing housing, wherein;

the housing provides means to fix the grinding wheel at the angle desired to grind a sharp cutting surface on the cup cutter, the cutting surface of the cup cutter being circular with multiple arced scallops, and the grinding wheel being positioned so that the periphery of the wheel contacts or interior edge of the scalloped cutting surface, the angle of the wheel being selected according to the desired angle of the cutting surface.

2. The device of claim 1 wherein:

multiple grinding wheels are utilized, each wheel contacting a separate and distinct scallop, so that multiple scallops are sharpened simultaneously.

3. The device of claim 2 wherein:

the number of grinding wheels is two.

4. The device of claim 2 wherein:

multiple motors are used to supply power to the grinding wheels, the number of motors being equal to the number of grinding wheels.

5. The device of claim 2 wherein:

the abrasive surface is replaceable.

6. The device of claim 1 wherein:

the abrasive surface is replaceable.

7. The device of claim 2 wherein:

a mandrel affixed to the housing keeps the scallops of the cup cutter in contact with the grinding wheels during sharpening, the mandrel allowing the cutter to float slightly so that wear of the abrasive surface is distributed evenly.

8. The device of claim 1 wherein:

a mandrel affixed to the housing keeps the scallops of the cup cutter in contact with the grinding wheels during the sharpening operation, the mandrel allowing the cutter to float slightly so that wear of the abrasive surface is distributed evenly.

* * * * *